US005627514A

United States Patent [19]

Morita

[11] Patent Number: 5,627,514

[45] Date of Patent: May 6, 1997

[54] FIRE DETECTOR AND FIRE RECEIVER

[75] Inventor: Toshikazu Morita, Tokyo, Japan

[73] Assignee: Nohmi Bosai Ltd., Tokyo, Japan

[21] Appl. No.: 399,598

[22] Filed: Mar. 7, 1995

[30] Foreign Application Priority Data

Mar. 18, 1994 [JP] Japan ..... 6-073864

[51] Int. Cl.[6] ..... G08B 29/00

[52] U.S. Cl. ..... 340/507; 340/500; 340/505; 340/506; 340/511; 340/588; 340/589; 340/514

[58] Field of Search ..... 340/505, 507, 340/511, 514, 588, 589, 527

[56] References Cited

U.S. PATENT DOCUMENTS 4,611,197 9/1986 Sansky ..... 340/527

5,084,825 1/1992 Kelly et al. ..... 364/507

*Primary Examiner*—Thomas Mullen
*Assistant Examiner*—Daryl C. Pope
*Attorney, Agent, or Firm*—Wenderoth, Lind & Ponack

[57] ABSTRACT

A fire detector is capable of self-detecting its own malfunction and is also capable of quickly announcing a failure of high-level emergency in the fire detector. A plurality of determining values are established for the output level of a physical quantity detector for detecting the physical quantity of a fire phenomenon such as smoke, and a different time is set for each of the determining values. A shorter time is set for greater deviation from the normal value of the output level. It is determined that the physical quantity detector is faulty if it is detected that the output level of the physical quantity detector continuously exceeds any of the established determining values for not less than the time which has been set for that particular determining value.

16 Claims, 8 Drawing Sheets

FIRE DETECTOR AND FIRE RECEIVER

BACKGROUND OF THE INVENTION

1. Field of the Invention

The present invention relates to a fire detector and a fire receiver which are equipped with a self-monitoring function.

2. Description of the Related Art

A conventional fire detector, e.g. a photoelectric type fire detector, is provided with a light emitting element and a light receiving element in a black box. In such a photoelectric type fire detector, the light emitted by the light emitting element is scattered by smoke, the scattered light is detected by the light receiving element, the detection signal is amplified through an amplifier, and the smoke concentration is determined according to the level of the output of the amplifier, thereby carrying out fire monitoring. In addition to such fire monitoring, the photoelectric type fire detector also detects the steady-state value (the steady-state value issued by the amplifier in the absence of a fire) of the photoelectric fire detector so as to carry out steady-state value monitoring, whereby it checks the photoelectric type fire detector for a malfunction according to the detected steady-state value.

A conventional system for checking the photoelectric type fire detector for a failure has been disclosed in Japanese Patent Publication No. 64-4239. The conventional system is provided with a light emitting element and a light receiving element for receiving the light from the light emitting element, and is also provided with an upper limit comparing circuit and a lower limit comparing circuit for comparing an output signal of the light receiving element. Remote control is carried out through the receiver to control the two comparing circuits incorporated in the photoelectric fire detector.

The conventional system has such a shortcoming that the steady-state value monitoring operation cannot be performed until the comparing circuits in the photoelectric fire detector are controlled through the receiver. Hence, the photoelectric fire detector cannot detect its own malfunction by itself, causing a heavy burden on the receiver.

SUMMARY OF THE INVENTION

Accordingly, it is an object of the present invention to provide a fire detector which is capable of self-detecting a malfunction thereof and also of quickly announcing a malfunction of high-level emergency in the fire detector.

It is another object of the present invention to provide a fire receiver which enables quick detection of a failure of high-level emergency in the fire detector when the fire receiver monitors the fire detector for a failure.

According to the present invention, a plurality of determination values are preset for the output level of a physical quantity detecting means for detecting the physical quantity of a fire phenomenon such as smoke, heat, flame, gas, and smell; a different time is set for each of the plurality of determination values; a shorter time is set for greater deviation from the normal value of the aforesaid output level; and if it is detected that the output level of the physical quantity detection means has exceeded any of the determination values mentioned above and has continued to exceed it for more than the time set for that particular determination value, then it is determined that the physical quantity detecting means has failed.

According to the present invention, two alarm failure determination values, for example, are provided; a longer determination time is set for a low-level alarm failure determination value (determination value with a low-level emergency) which is close to the normal value of the output level of the amplifying circuit, so that an alarm failure warning is given if an output level which exceeds only the low-level alarm failure determination value continues for the preset longer determination time. A shorter determination time is set for a high-level alarm failure determination value (determination value with a high level of emergency) which greatly deviates from the normal value of the output level of the amplifying circuit, so that the alarm failure warning is given if an output level which exceeds the high-level error alarm determination value continues for the preset shorter determination time. This enables the fire detector to detect its own failure and quickly issue an alarm failure warning in response to the high-level emergency alarm failure.

DESCRIPTION OF THE PREFERRED EMBODIMENTS

Figure 1:
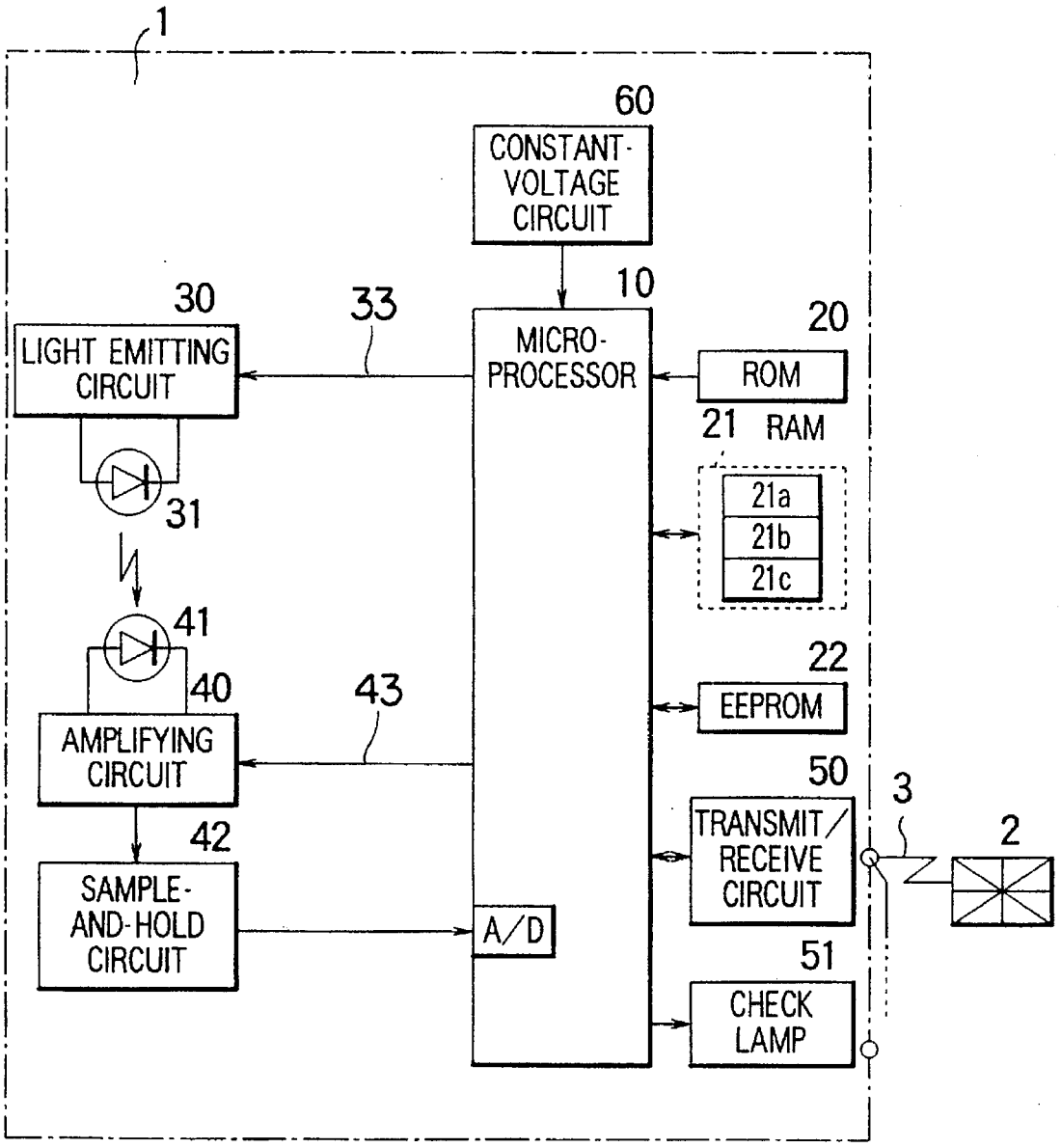
FIG. 1 is a block diagram illustrative of an embodiment of the present invention.

FIG. 1 is the block diagram illustrative of a photoelectric smoke-fire detector 1 which is an embodiment the present invention.

Figure 2:
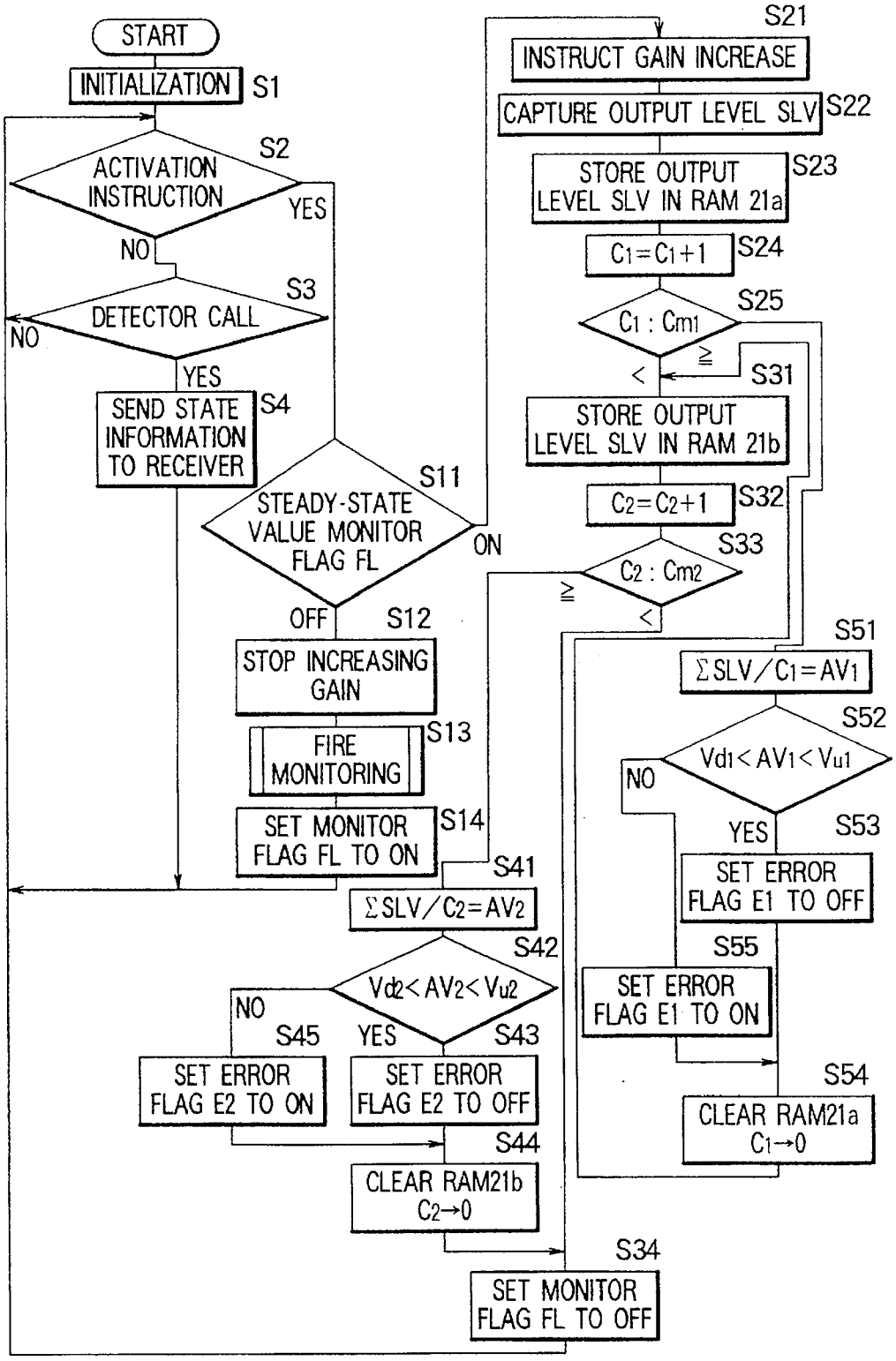
FIG. 2 is a flowchart showing the operation implemented by a microprocessor, wherein the operation for detecting both alarm failure and false alarm is illustrated.

The embodiment shown in FIG. 1 is equipped with a microprocessor 10 which controls the entire photoelectric type smoke-fire detector 1, ROM 20 for storing the program shown by the flowchart of FIG. 2, and RAM 21 which includes RAM 21*a*, 21*b*, and 21*c*, the RAM 21*a* and 21*b* storing output level SLV of a sample-and-hold circuit 42, and the RAM 21*c* serving as a working area for storing steady-state value monitoring flag FL for actuating steady-state value monitoring, error flags E1, E2 for indicating that the smoke-fire detector 1 has failed, and the number of times C1 and C2 that the microprocessor 10 has captured output level SLV.

An EEPROM 22 stores the address of the smoke-fire detector 1, set values, the first upper limit value Vu1 of the output level (actually output level SLV of the sample-and-hold circuit 42) of an amplifying circuit 40, the second upper limit value Vu2 which is larger than the first upper limit value Vu1, the first lower limit value Vd1, the second lower limit value Vd2 which is smaller than the first lower limit value Vd1, the first number of times Cm1 which corresponds to the first time duration, and the second number of times Cm2 corresponding to the second time duration which is shorter than the first time duration.

The first number of times Cm1 refers to the number of times that it is determined that the average output level of the amplifying circuit 40 deviates from the range defined by the upper limit value Vu1 and the first lower limit value Vd1 when the amplification factor is increased. The second number of times Cm2 refers to the number of times that it is determined that the average output level of the amplifying circuit 40 deviates from the range defined by the upper limit value Vu1 and the first lower limit value Vd1 when the amplification factor is increased; it is set at a lower value than the first number of times.

A light emitting circuit 30 supplies a light emitting current pulse to a light emitting element 31 in response to a light emitting control pulse 33 received from the microprocessor 10. The amplifying circuit 40 amplifies the output level of a light receiving element 41 in accordance with a predetermined amplification factor. The amplifying circuit 40 amplifies the output level at the normal amplification factor during the fire monitoring. During the steady-state value monitoring, the amplifying circuit 40 receives a gain directing signal 43 from the microprocessor 10 and amplifies the output level at a amplification factor which is higher than that during the fire monitoring. After the steady-state value monitoring is over, the amplifying circuit 40 restores the normal amplification factor. The amplifying circuit 40 repeats the operation stated above.

A transmit/receive circuit 50 has a transmitting circuit for transmitting such signals as the physical quantity signal of smoke concentration, fire signal, and malfunction signal from the microprocessor 10 to a fire receiver 2 and a receiving circuit for receiving a polling call signal or other like signals from the fire receiver 2 and sending it to the microprocessor 10. A check lamp 51 lights up when the smoke-fire detector 1 has detected a fire. A constant-voltage circuit 60 turns the voltage supplied to the detector 1 from the receiver 2 via a power/signal line 3 into a required constant voltage and supplies it to the microprocessor 10, etc.

The light emitting circuit 30, the light emitting element 31, the amplifying circuit 40, the light receiving element 41, and the sample-and-hold circuit 42 are examples of the means for detecting the physical quantities of fire phenomena.

The EEPROM 22 is the example of: the first upper limit value setting means for setting the first upper limit value; and the second upper limit value setting means for setting the second upper limit value, which is larger than the first upper limit value, with respect for the output level (actually output level SLV of the sample-and-hold circuit 42) of the physical quantity detecting means; the first lower limit value setting means for setting the first lower limit value, the second lower limit value setting means for setting the second lower limit value which is smaller than the first lower limit value, with respect to the aforesaid output level; and the first time duration setting means for setting the first time duration; the second time duration setting means for setting the second time duration which is shorter than the first time duration; the third time duration setting means for setting the third time duration; and the fourth time duration setting means for setting the fourth time duration which is shorter than the third time duration.

The microprocessor 10 is an example of the means which determines that the physical quantity detecting means is faulty if it detects that the output level of the physical quantity detecting means exceeds the first upper limit value for the first time duration; which determines that the physical quantity detecting means is faulty if it detects that the aforesaid output level exceeds the second upper limit value for the second time duration; which determines that the physical quantity detecting means is faulty if it detects that the output level is smaller than the first lower limit value for the third time duration; and which determines that the physical quantity detecting means is faulty if it detects that the output level is smaller than the second lower limit value for the fourth time duration.

The operation of the embodiment stated above will now be described.

FIG. 2 shows the flowchart of the operation implemented by the microprocessor 10 in the embodiment described above, wherein the operation for detecting both alarm failure and false alarm is illustrated.

First, initial values are set(S1). If the smoke-fire detector 1 has not received an activation instruction from the fire receiver 2 connected through the signal/power line 3 (S2) and the fire receiver 2 calls up the fire detector 1 (S3), then the state information held by the fire detector 1 is sent to the fire receiver 2 (S4). A pulse or the like which is periodically generated in the fire detector 1 may be used as the activation instruction in step S2 instead of the activation instruction received from the receiver 2.

If the activation instruction, which is issued once every three seconds, for example, is received (S2) and flag FL for monitoring the steady-state value of the fire detector 1 is OFF (S11), then the system stops increasing the amplification factor of the amplifying circuit 40 (S12), carries out fire monitoring (S13), and sets monitoring flag FL to ON in preparation for the steady-state value monitoring to be implemented next (S14).

If steady-state value monitoring flag FL is ON in step S11, the system instructs the amplifying circuit 40 to increase the amplification factor, and issues the light emitting control pulse to the light emitting circuit 30 so as to cause the light emitting element 31 to emit light. Then, the light receiving output of the light receiving element 41 is amplified by the amplifying circuit 40 at a great amplification factor to enable easy steady-state value monitoring (S21). The microprocessor 10 captures output level SLV of the sample-and-hold circuit 42 (S22), stores it in the RAM 21*a* (S23), increments by 1 the number of times C1 that it has captured output level SLV (S24), and compares it with the first number of times Cm1, e.g. 20 times (S25).

The first number of times Cm1 corresponds to the first hour required to issue an alarm of the low-level emergency. An example of the alarm of the low-level emergency is an alarm failure of a low-level emergency. This is an alarm failure warning or "expired life alarm" attributable to gradual reduction in the output level of the sample-and-hold circuit 42 which takes place as the surface of the light emitting element 31 or the light receiving element 41 is soiled by dust, etc. over an extended period of time. In this case, although the sensitivity of the fire detector 1 becomes lower than the normal sensitivity level, the fire detector 1 does not lose its fire detecting function. False alarm warning of the low-level emergency is issued in the same manner as that for the alarm failure warning of the low-level emergency.

If the number of times C1 is less than 20 in step S25, then output level SLV of the sample-and-hold circuit 42 is stored in the RAM 21*b* (S31), the number of times C2 that the microprocessor 10 has captured output level SLV is incremented by 1 (S32), and the incremented value is compared with the second number of times Cm2, e.g. 3 times (S33).

The second number of times Cm2 corresponds to the second time duration required to issue an alarm of the high-level emergency. An example of the alarm of the high-level emergency is an alarm failure warning of the high-level emergency. This is an alarm failure warning wherein the light emitting element 31 or the light receiving element 41 is disconnected, causing a sudden drop in the output level of the sample-and-hold circuit 42. In this case, the fire detecting function is entirely lost and no detection of a fire can be performed if a fire breaks out; therefore, immediate alarm failure warning must be given. False alarm warning of the high-level emergency is issued in the same manner as that for the alarm failure warning of the high-level emergency.

If it is found in step S33 that number of times C2 is less than 3, then it indicates that the monitoring is being implemented; therefore, the system terminates one steady-state value monitoring without determining whether the error flag should be set to ON or OFF, and sets steady-state value monitoring flag FL to OFF to prepare for the next fire monitoring (S34) before it goes back to step S2.

If the system finds in step S33 that number of times C2 is 3 or more, then it calculates mean value AV2 of output level SLV by dividing the sum of output levels SLV, which have been stored in the RAM **21*b* up to that moment, by number of times C2 (S41). If obtained mean value AV2 lies between the second lower limit value Vd2 for which the alarm failure warning of the high-level emergency need not be issued and the second upper limit value Vu2 for which the false alarm warning of the high-level emergency must be issued (S42), then there is no need to issue the warning of the high-level emergency. Hence, the system sets error flag E2, which indicates that a malfunction of the high-level emergency has occurred, to OFF (S43), clears the contents of the RAM 21*b* (output level SLV), and sets the variable of number of times C2 of capture to "0" (S44). If mean value AV2 of output level SLV is smaller than the second lower limit value Vd2 or larger than the second upper limit value Vu2 (S42), it means that a malfunction of the high-level emergency has occurred. Hence, the system sets error flag E2, which indicates that the malfunction of the high-level emergency has occurred, to ON (S45), clears the contents of the RAM 21*b*** (output level SLV), and sets the variable of the number of times C2 of capture to "0" (S44).

On the other hand, if the system finds in step S25 that number of times C1 is 20 or more, then it determines mean value AV1 of output level SLV by dividing the sum of output levels SLV, which have been stored in the RAM **21*a* up to that moment, by number of times C1 (S51). If obtained mean value AV1 lies between the first lower limit value Vd1 for which the alarm failure warning of the low-level emergency need not be issued and the first upper limit value Vu1 for which the false alarm warning of the low-level emergency need not be issued (S52), then it indicates the normal state. Hence, the system sets error flag E1, which indicates that a malfunction of the low-level emergency has occurred, to OFF (S53), clears the contents of the RAM 21*a* (output level SLV), and sets the variable of number of times C1 of capture to "0" (S54). If mean value AV1 of output level SLV is not greater than the first lower limit value Vd1 or not less than the first upper limit value Vu1 (S52), it means that a malfunction of the low-level emergency has occurred. Hence, the system sets error flag E1, which indicates that the malfunction of the low-level emergency has occurred, to ON (S55), clears the contents of the RAM 21*a*** (output level SLV), and sets the variable of number of times C1 of capture to "0" (S54).

When the smoke-fire detector 1 receives a state report instruction from the receiver 2 (S4), it supplies the state of failure flag E1 or E2 along with the address thereof and fire monitoring information to the receiver 2. At this time, if the flag E1 or E2 is ON, then the receiver can recognize that the smoke-fire detector 1 is faulty.

Figure 3:
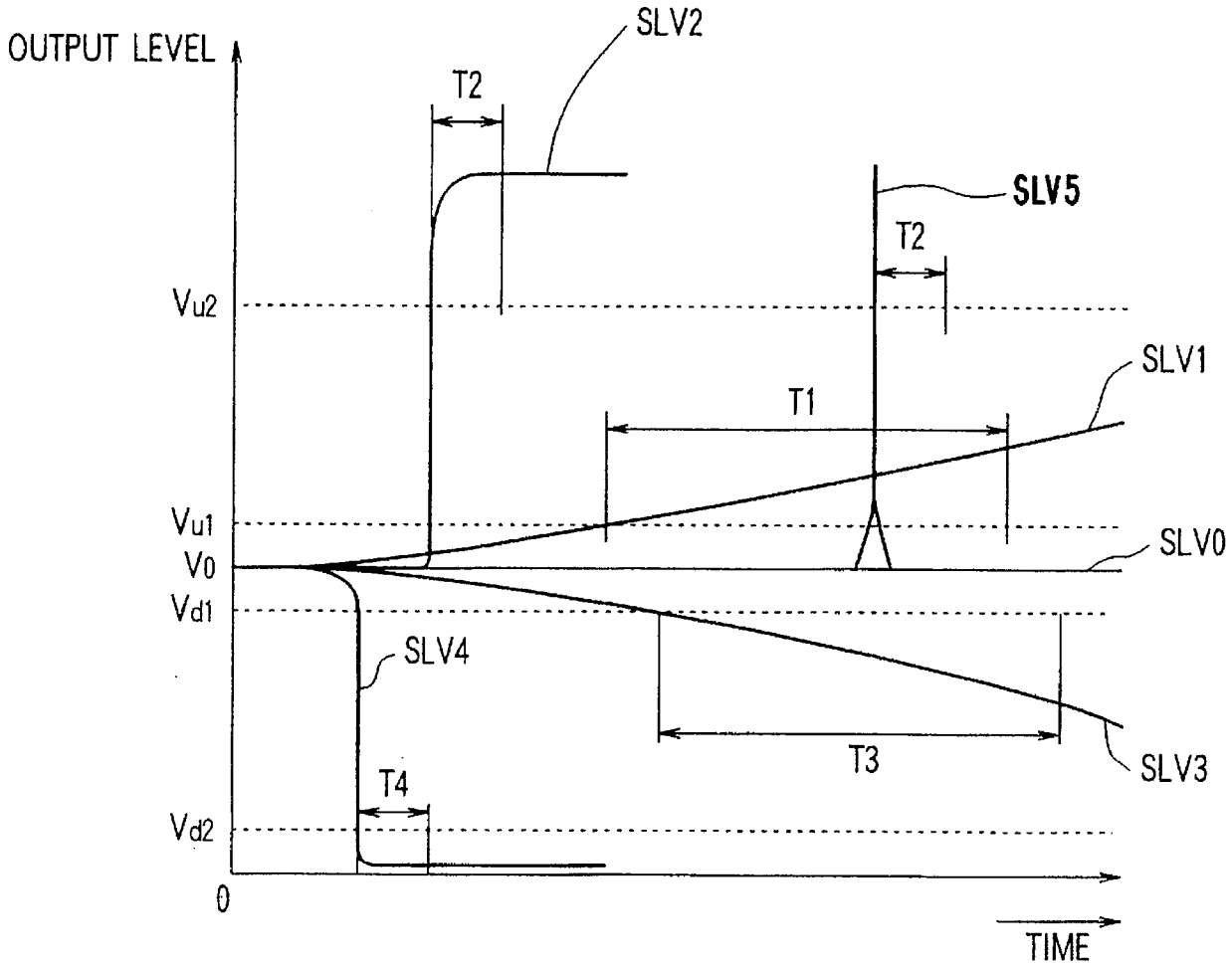
FIG. 3 is a time chart showing the operation of the embodiment stated above.

FIG. 3 is the time chart illustrating the operation of the embodiment stated above.

In FIG. 3, output level SLV0 indicates the characteristic which is observed when the output does not vary from initial noise level V0. Output level SLV1 is an example wherein output level SLV has gradually increased with age. When the continuous time which is greater than the first upper limit value Vu1 has grown longer than the first time duration T1, the false alarm warning of the low-level emergency is issued. Output level SLV2 is an example wherein output level SLV has suddenly increased due to a corroded circuit or the like with a resultant abnormal increase in the quantity of emitted light. When the continuous time which is further greater than the second upper limit value Vu2 (the value which is greater than the first upper limit value Vu1) has grown longer than the second time duration T2 (the time which is shorter than the first time duration T1), the false alarm warning of the high-level emergency is issued.

Output level SLV3 is an example wherein output level SLV has gradually decreased with age. When the continuous time which is smaller than the first lower limit value Vd1 has grown longer than the third time duration T3, the alarm failure warning of the low-level emergency is issued. Output level SLV4 is an example wherein output level SLV has suddenly decreased due to element disconnection or the like. When the continuous time which is further smaller than the second lower limit value Vd2 (the value which is smaller than the first lower limit value Vd1) has grown longer than the fourth time duration T4 (the time which is shorter than the third time duration T3), the alarm failure warning of the high-level emergency is issued.

In the above embodiment, since the second time duration T2 and the fourth time duration T4 for detecting a failure of the high-level emergency are set shorter than the first time duration T1 and the third time duration T3, respectively, if a malfunction of the high-level emergency occurs, the smoke-fire detector 1 itself is capable of quickly detecting the malfunction of the high-level emergency (alarm failure or false alarm of the high-level of emergency). Hence, the fire receiver 2 can quickly find the malfunction of the smoke-fire detector 1 by frequently sending the state report instruction to the smoke-fire detector 1. Moreover, the smoke-fire detector 1 carries out the steady-state value monitoring by itself; therefore, the smoke-fire detector 1 itself can detect its own malfunction, reducing the load on the receiver.

Even if the output level suddenly increases (SLV5) momentarily due to flash or the like during the period of output level SLV0 during which the output is not supposed to vary, it will not be judged as a false alarm if the time (the duration of the increase) is shorter than the second time duration T2.

In the embodiment described above, the first number of times Cm1 for the first time duration T1 and the third time duration T3 is set to 20 and the second number of times Cm2 for the second time duration T2 and the fourth time T4 is set to 3. The first number of times Cm1 and the second number of times Cm2, however, may be set for other values as long as the first number of times Cm1 is set for a value which is greater than that of the second number of times Cm2.

Further alternatively, the first number of times Cm1 for judging the first lower limit value Vd1 may be set to a different value from that of the first number of times Cm1 for judging the first upper limit value Vu1. Likewise, the second number of times Cm2 for judging the second lower limit value Vd2 may be set to a different value from that of the second number of times Cm2 for judging the second upper limit value Vu2.

In general, the photoelectric type smoke-fire detector carries out self-monitoring as follows: minute light emitted from the light emitting element is reflected on a wall surface in the black box when there is no smoke; the reflected light is received by the light receiving element and the received light output is amplified through the amplifying circuit; and the amplified output value is monitored. The output value is small and therefore poses a problem with the judgment accuracy. On the other hand, however, using a large amplification factor of the amplifying circuit all the time undesirably limits the smoke detecting range. The embodiment stated above, however, is equipped with a means for switching the amplification factor to a higher level than the normal level only during malfunction detection. This ensures higher determination accuracy by providing a sufficiently large amplification factor for failure detection and it enables detection of smoke of low to high concentrations with the normal amplification factor during the detection of a fire without causing the saturation of the amplifying circuit.

Figure 4:
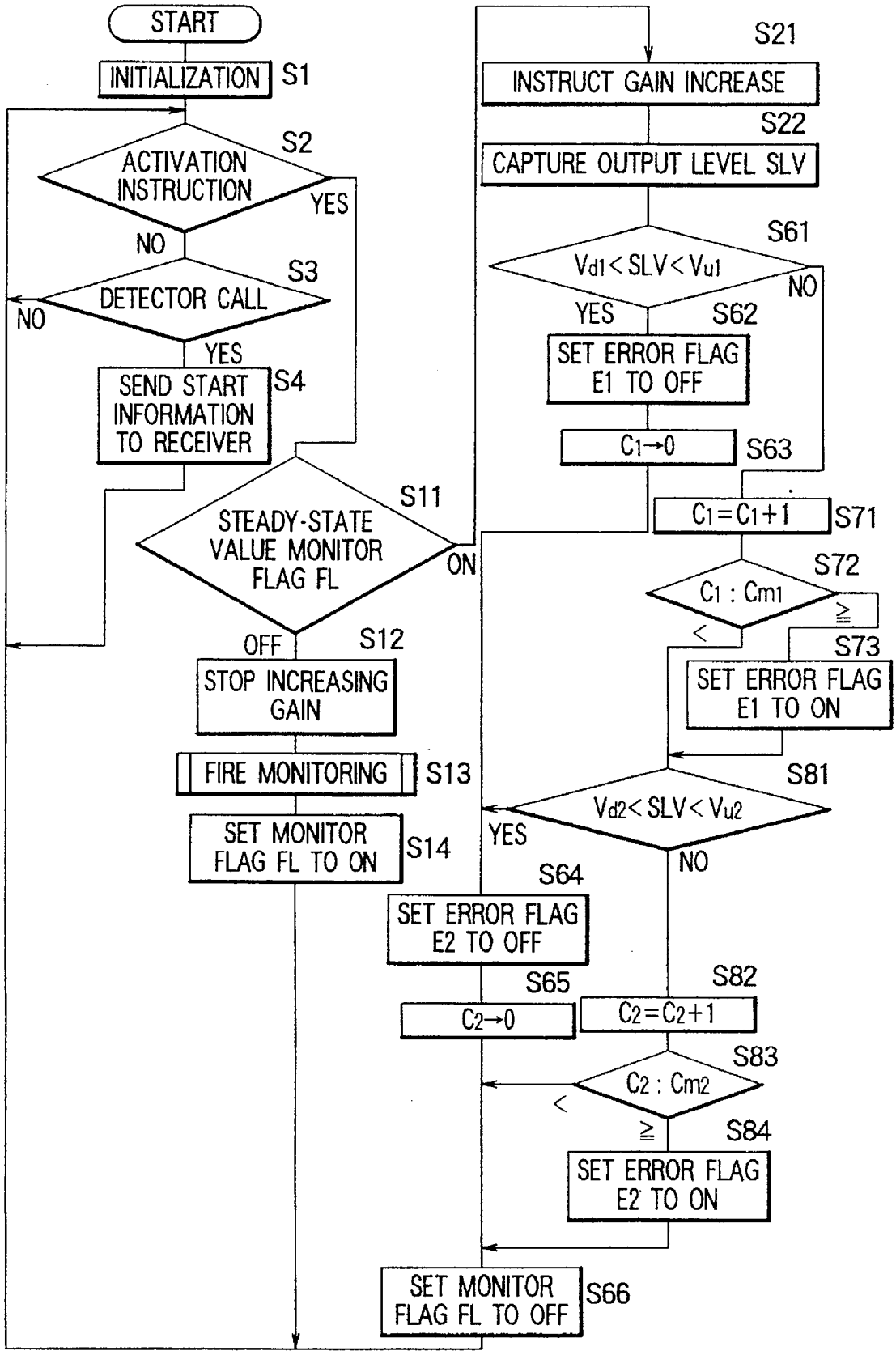
FIG. 4 is a flowchart showing a modification of the flowchart given in FIG. 2, wherein the microprocessor determines whether output level SLV has deviated from a predetermined range or not before counting the number of times that it has captured output level SLV.

FIG. 4 shows a modification of the flowchart given in FIG. 2. According to the operation procedure shown in FIG. 4, whether output level SLV has deviated from a predetermined range or not is determined first, then the number of times that the microprocessor has captured output level SLV is counted by the microprocessor 10.

In the flowchart shown in FIG. 4, steps S1 to S22 are identical to steps S1 to S22 shown in FIG. 2.

The microprocessor 10 captures output level SLV of the sample-and-hold circuit 42 (S22), and if the output level SLV shows a value which lies between the first lower limit value Vd1 which does not require the issuance of the alarm failure warning of the low-level emergency and the first upper limit value Vu1 which does not require the issuance of the false alarm warning of the low-level emergency (S61), then error flag E1 which indicates that a malfunction of the low-level emergency has occurred is set to OFF (S62), the variable of the number of times C1 of capture is set to "0" (S63), error flag E2 which indicates that a malfunction of the high-level emergency has occurred to OFF (S64), the variable of number of times C2 of capture is set to "0" (S65), and monitoring flag FL is set to OFF (S66).

If, in step S61, it is determined that the output level SLV is smaller than the first lower limit value Vd1 or larger than the first upper limit Vu1 (S61), then the variable of number of times C1 of capture is incremented by 1 (S71), and number of times C1 of capture is compared with the first number of times Cm1, e.g. 20 (S72). If number of times C1 of capture is found to be 20 or more, it means that a malfunction of the low-level emergency has occurred; therefore, error flag E1 is set to ON (S73). If number of times C1 of capture is found to be below 20, then error flag E1 is left OFF.

If output level SLV of the sample-and-hold circuit 42 is found to be smaller than the second lower limit value Vd2 which requires the issuance of the alarm failure warning of the high-level emergency or larger than the second upper limit Vu2 which requires the issuance of the false alarm warning of the high-level emergency (S81), then the variable of number of times C2 of capture is incremented by 1 (S82), and number of times C2 of capture is compared with the second number of times Cm2, e.g. 3 (S83). If number of times C2 of capture is found to be 3 or more, it means that a malfunction of the high-level emergency has occurred; therefore, error flag E2 is set to ON (S84).

Figure 5:
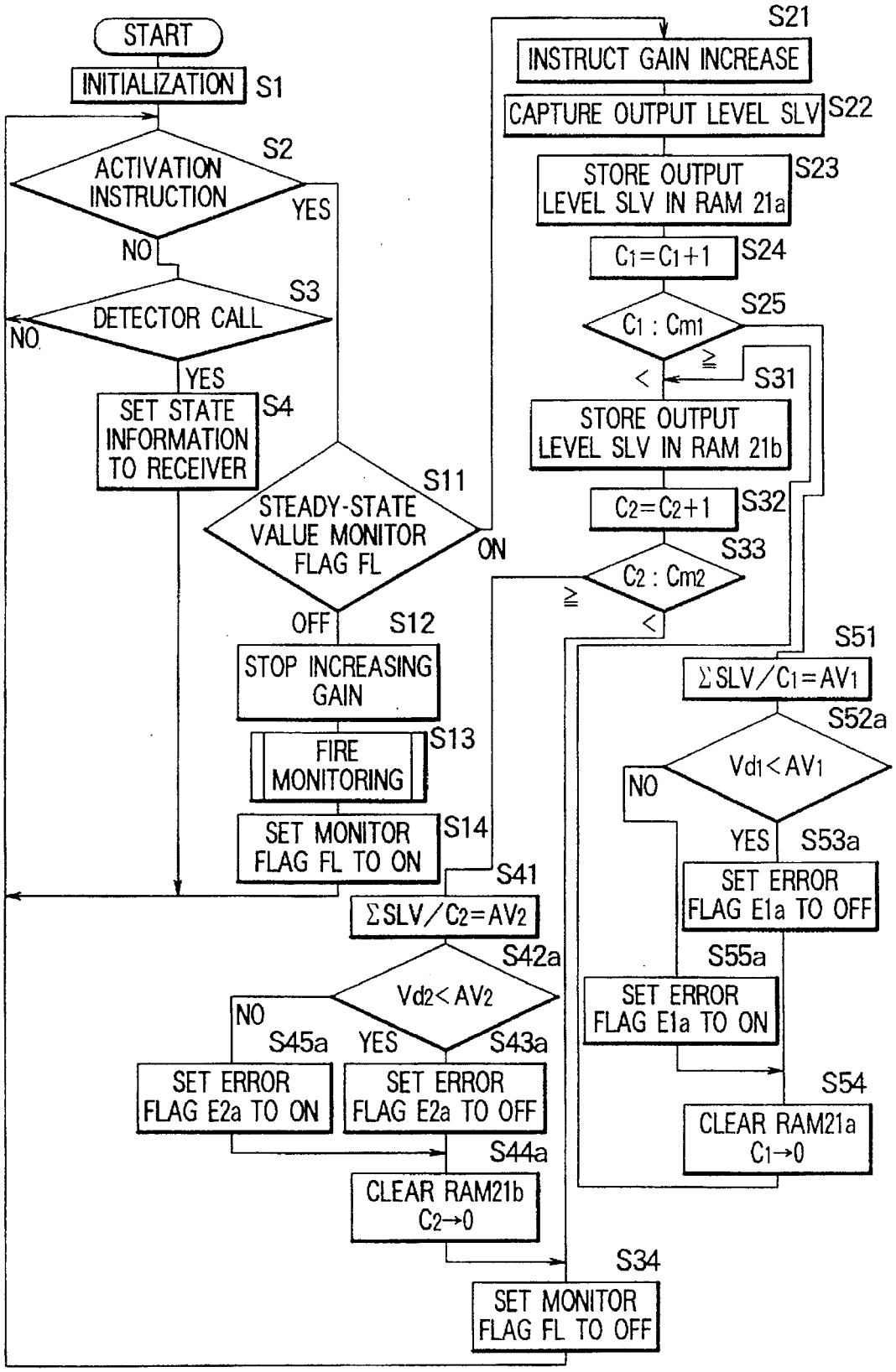
FIG. 5 is a flowchart showing the operation carried out by the microprocessor in the embodiment, wherein the operation is focused only on the detection of an alarm failure.

FIG. 5 is the flowchart showing the operation carried out by the microprocessor 10 in the embodiment, wherein the operation is focused only on the detection of a alarm failure.

The flowchart shown in FIG. 5 is basically identical to the flowchart given in FIG. 2 except that steps S42*a*, S43*a*, and S45*a* are provided in place of steps S42, S43, and S45 of the flowchart of FIG. 2; and steps S52*a*, S53*a*, and S55*a* are provided in place of steps S52, S53, and S55 of the flowchart of FIG. 2.

In step S42*a*, it is determined whether mean value AV2 of a plurality of the values of output level SLV stored in the RAM 21*b* is smaller than the second lower limit value Vd2. If the mean value is smaller than the second lower limit value Vd2, it means that a malfunction of the high-level emergency related to alarm failure has occurred; therefore, error flag E2*a* indicating such malfunction is set to ON (S45*a*). If mean value AV2 of output level SLV is found to be the second lower limit value Vd2 or more (S42*a*), then error flag E2*a* is set to OFF (S43*a*).

In step S52*a*, it is determined whether mean value AV1 of a plurality of the values of output level SLV stored in the RAM 21*a* is smaller than the first lower limit value Vd1. If the mean value is smaller than the first lower limit value Vd1, it means that a malfunction of the low-level emergency related to alarm failure has occurred; therefore, error flag E1*a* indicating such malfunction is set to ON (S55*a*). If mean value AV1 of output level SLV is found to be the first lower limit value Vd1 or more (S52*a*), then error flag E1*a* is set to OFF (S53*a*).

As shown in FIG. 5, even when the operation of the system is focused only on the detection of an alarm failure, which leads to the malfunction of fire detection, a malfunction of the smoke-fire detector can be quickly found. Moreover, the smoke-fire detector itself can detect its own malfunction.

Figure 6:
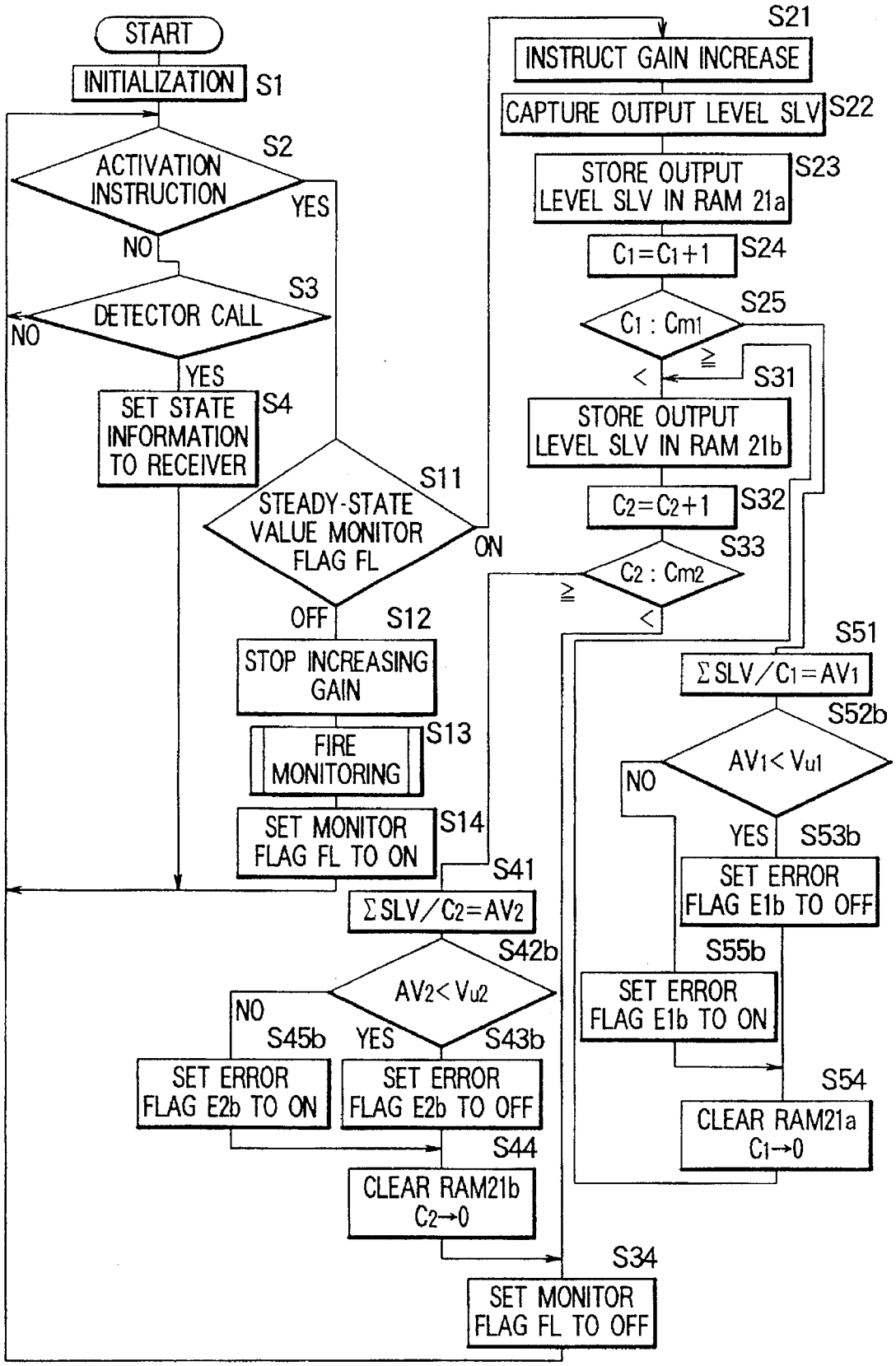
FIG. 6 is a flowchart showing the operation carried out by the microprocessor in the embodiment, wherein the operation is focused only on the detection of a false alarm.

FIG. 6 is the flowchart showing the operation carried out by the microprocessor 10 in the embodiment described above, wherein the operation is focused only on the detection of a false alarm.

The flowchart shown in FIG. 6 is basically identical to the flowchart given in FIG. 2 except that steps S42*b*, S43*b*, and S45*b* are provided in place of steps S42, S43, and S45 of the flowchart of FIG. 2; and steps S52*b*, S53*b*, and S55*b* are provided in place of steps S52, S53, and S55 of the flowchart of FIG. 2.

In step S42*b*, it is determined whether mean value AV2 of a plurality of the values of output level SLV stored in the RAM 21*b* is smaller than the second upper limit value Vu2. If the mean value is larger than the second upper limit value Vu2, it means that a malfunction of the high-level emergency related to false alarm has occurred; therefore, error flag E2*b* indicating such malfunction is set to ON (S45*b*). If mean value AV2 of output level SLV is found to be the second upper limit value Vu2 or less (S42*b*), then error flag E2*b* is set to OFF (S43*b*).

In step S52*b*, it is determined whether mean value AV1 of a plurality of the values of output level SLV stored in the RAM 21*a* is greater than the first upper limit value Vu1. If the mean value is greater than the first upper limit value Vu1, it means that a malfunction of the low-level emergency related to false alarm has occurred; therefore, error flag E1*b* indicating such malfunction is set to ON (S55*b*). If mean value AV1 of output level SLV is found to be the first upper limit value Vu1 or less (S52*b*), then error flag E1*b* is set to OFF (S53*b*).

As shown in FIG. 6, even when the operation of the system is focused only on the detection of a false alarm, a malfunction of the smoke-fire detector can be quickly found. Moreover, the smoke-fire detector itself can detect its own malfunction.

The above embodiment is an example wherein it is applied to the photoelectric type smoke-fire detector 1, however, the embodiment may be applied to a heat-fire detector instead of the photoelectric type smoke-fire detector 1. In this case, a thermistor, for example, is used as a heat detecting element, and normally, the resistance value of the thermistor is monitored. It is necessary to establish a criterion for the output value of the thermistor to carry out the determination of a malfunction; the criterion value varies with the determination method of each heat-fire detector. In the case of fire determination by the differential method, a method of looking at the difference in output from that before a predetermined time, and another comparing the outputs of a heat sensing element such as thermistor which is located in the fire detector and not readily influenced by open air are known as a method of determining the differential value (change in temperature). In the differential method, the outputs before the predetermined time or of the internal heat sensing element are used as references, rate of change or deviation from which is used for calculation of a value for determining a malfunction. In the case of a constant-temperature fire determination system, the output value of the thermistor may be directly used to calculate the criterion value for malfunction determination.

The embodiment described above may be applied to a flame-fire detector, which is designed to detect infrared ray, ultraviolet ray or other ray, or a gas-fire detector, which is designed to detect smell, CO or other combustion products in addition to the smoke-fire detector or the heat-fire detector.

Furthermore, the above embodiment is an example related to a fire detector; however, the embodiment may be applied to a fire receiver if an analog fire detector is employed because the analog type fire detector is capable of transmitting an output level, which corresponds to a physical quantity of a fire phenomenon, to the fire receiver.

Figure 7:
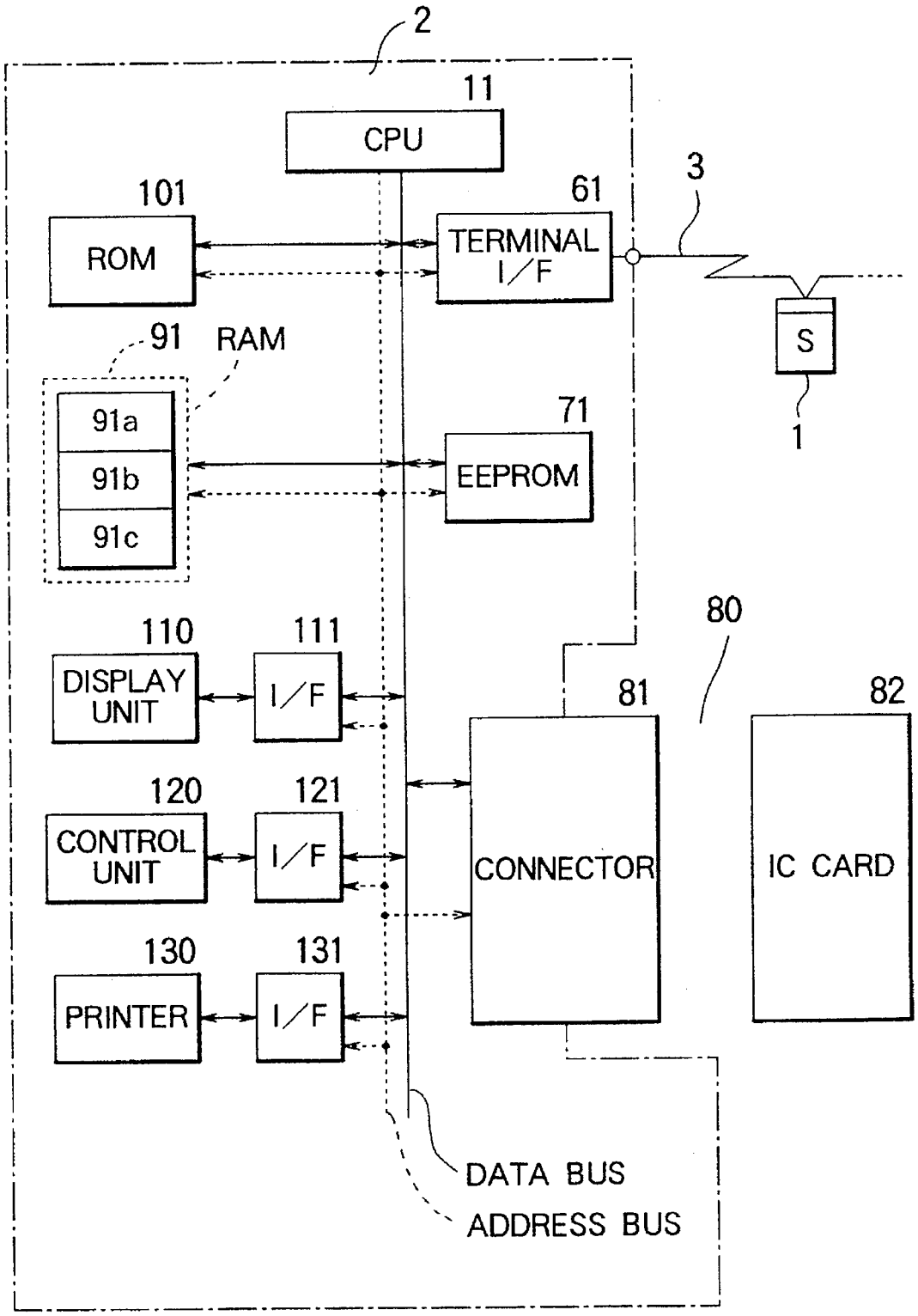
FIG. 7 is a block diagram showing a fire receiver which is another embodiment of the present invention.

FIG. 7 is a block diagram showing the fire receiver 2 which is another embodiment of the present invention.

The embodiment shown in FIG. 7 has a CPU (microprocessor) 11 which controls the entire receiver 2 and a terminal such as an analog fire detector 1 connected to the receiver 2, ROM 101 for storing a program for controlling the receiver 2 and a terminal connected thereto, and RAM 91 which includes RAMs 91*a*, 91*b*, and 91*c*, the RAMs 91*a* and 91*b* being used to store output level SLV collected from each fire detector 1 for each address by polling (the role of the output level in the fire detector 1 of FIGS. 1 to 6), and the RAM 91*c* serving as a working area which is used to store, for each fire detector, steady-state value monitoring flag FL for actuating the steady-state value monitoring, and the number of times C1 and C2 that output level SLV has been captured by polling.

The receiver 2 has an EEPROM 71 for recording set data (interlock data, data on terminals, display data, etc.), a connector 81 for connecting an IC card 82 to a bus in the receiver 2, a display unit 110 which displays a fire district, the location of automatic test, etc. and which is composed primarily of LED and LCD, an interface 111 for the display unit 110, a control unit 120 mainly comprised of switches, an interface 121 for the control unit, a printer 130, and an interface 131 for the printer 130. The IC card 82 is inserted in a port 80.

Just like the EEPROM 22 of the fire detector 1 shown in FIG. 1, the EEPROM 71 also stores the first upper limit value Vu1, the second upper limit value Vu2, the first lower limit value Vd1, the second lower limit value Vd2, the first number of times Cm1, and the second number of times Cm2.

Just like the microprocessor 10 of the detector 1 shown in FIG. 1, the CPU 11 is an example of the means which determines that the physical quantity detecting means of the fire detector is faulty if it detects that the output level corresponding to a physical quantity of a fire phenomenon, which is detected by each fire detector, exceeds the first upper limit value for the first time duration; which determines that the physical quantity detecting means of the fire detector is faulty if it detects that the aforesaid output level exceeds the second upper limit value for the second time duration; which determines that the physical quantity detecting means of the fire detector is faulty if it detects that the output level is smaller than the first lower limit value for the third time duration; and which determines that the physical quantity detecting means of the fire detector is faulty if the output level is found to be smaller than the second lower limit value for the fourth time duration.

The operation of the receiver 2 described above will now be discussed.

Figure 8:
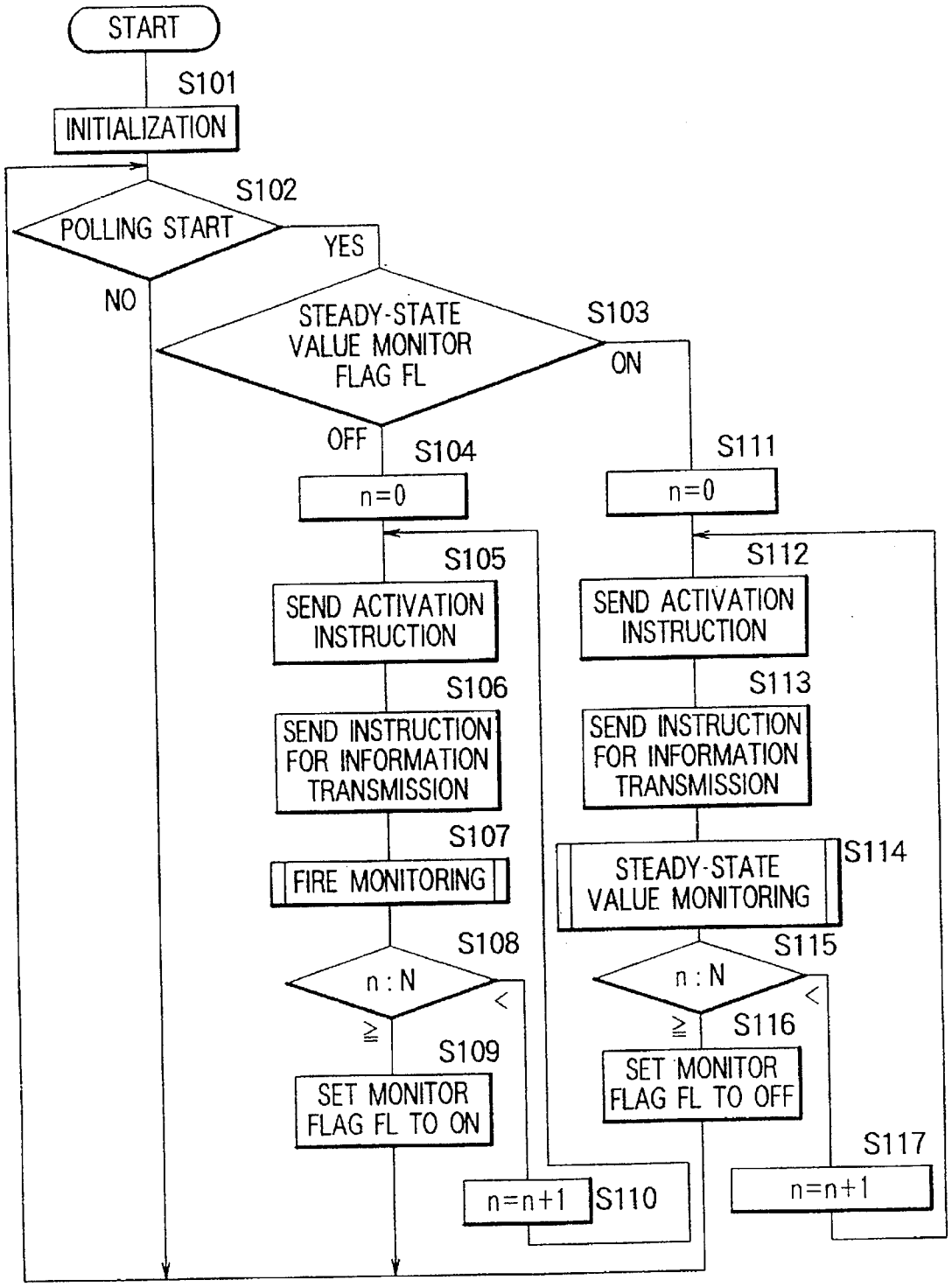
FIG. 8 is a flowchart showing the operation implemented by a CPU in the receiver.

FIG. 8 is the flowchart showing the operation implemented by the CPU 11 in the receiver 2.

First, initialization is performed (S101), then polling is initiated according to clock pulses which time the polling not illustrated (S102). If flag FL, which indicates that the fire detector 1 is ready to send the data for steady-state value monitoring, is OFF (S103), then the activation instruction is sent (S105) to each fire detector 1 for each address (S104, S108, S110) so as to cause it to create output level SLV and to cause it send back the output level SLV by the state information transmitting instruction (S106) to carry out the fire monitoring (S107). Then, flag FL is set to ON in preparation for the steady-state value monitoring to be implemented next (S108).

If steady-state value monitoring flag FL is found ON in step S103, then, as in the case of the fire monitoring, the activation instruction is sent (S112) to each fire detector 1 for each address (S111, S115, S117) so as to cause it to create output level SLV for the steady-state value monitoring and to cause it to send back the output level SLV by the state information transmitting instruction (S113) to carry out the steady-state value monitoring (S114). Then, flag FL is set to OFF (S116).

The steady-state value monitoring in step S114 involves the implementation of steps S23 through S25, S31 through S33, S41 through S45, and S51 through S55 of FIG. 2 which are involved in the steady-state value monitoring for the fire detector 1 and also the implementation of steps S61 through S65, S71 through S73, and S81 through S84 of FIG. 4. The RAM 21 of the fire detector 1 shown in FIG. 1 uses a RAM 91 of the receiver 2.

More specifically, the detection of a false alarm requires that the fire receiver be provided with the first upper limit value setting means for setting the first upper limit value, the second upper limit value setting means for setting the second upper limit value which is larger than the first upper limit value, the first time duration setting means for setting the first time duration, the second time duration setting means for setting the second time duration which is shorter than the first time duration, and a determining means, for the output level corresponding to the physical quantity of a fire phenomenon which is based on a signal received from the fire detector. The determining means used for this purpose functions to determine that the fire detector is faulty (and it is necessary to issue a false alarm warning) when it detects that the output level is larger than the first upper limit value for the first time duration; it also functions to determine that the fire detector is faulty (and it is necessary to issue a false alarm warning) when it detects that the output level exceeds the second upper limit value for the second time duration.

Likewise, the detection of an alarm failure requires that the fire receiver be provided with the first lower limit value setting means for setting the first lower limit value, the second lower limit value setting means for setting the second lower limit value which is smaller than the first lower limit value, the first time duration setting means for setting the first time duration, the second time duration setting means for setting the second time duration which is shorter than the first time duration, and a determining means, for the output level corresponding to the physical quantity of a fire phenomenon which is detected by the fire detector. The determining means used for this purpose functions to determine that the fire detector is faulty (and it is necessary to issue an alarm failure warning) when it detects that the output level is smaller than the first lower limit value for the first time duration; it also functions to determine that the fire detector is faulty (and it is necessary to issue an alarm failure warning) when it detects that the output level is smaller than the second lower limit value for the second hour.

Further, the detection of both alarm failure and false alarm requires that the fire receiver be provided with the first upper limit value setting means for setting the first upper limit value, the second upper limit value setting means for setting the second upper limit value which is larger than the first upper limit value for the output level corresponding to the physical quantity of a fire phenomenon which is detected by the fire detector, the first time duration setting means for setting the first time duration, the second time duration setting means for setting the second time duration which is shorter than the first time duration, and a determining means, and also with the first lower limit value setting means for setting the first lower limit value, the second lower limit value setting means for setting the second lower limit value which is smaller than the first lower limit value, time duration, the third time duration setting means for setting the third time duration, the fourth time duration setting means for setting the fourth time duration which is shorter than the third time duration and a determining means for the output level. The determining means used for this purpose functions to determine that the fire detector is faulty (and it is necessary to issue the false alarm warning) when it detects that the output level is larger than the first upper limit value for the first time duration; it functions to determine that the fire detector is faulty (and it is necessary to issue the false alarm warning) when it detects that the output level is larger than the second upper limit value for the second time duration; it functions to determine that the fire detector is faulty (and it is necessary to issue the alarm failure warning) when it detects that the output level is smaller than the first lower limit value for the third time duration; and it functions to determine that the fire detector is faulty (and it is necessary to issue the alarm failure warning) when it detects that the output level is smaller than the second lower limit value for the fourth time duration.

In the case stated above, the fire detector may be any one of the smoke-fire detector, heat-fire detector, flame-fire detector, and gas(smell)-fire detector.

In the embodiments described above, two upper limit values are provided. Alternatively, however, three upper limit values may be provided; in this case, when setting the time durations for the three upper limit values, the time durations for larger upper limit values must be set shorter.

Likewise, two lower limit values are provided in the embodiments described above. Alternatively, however, three lower limit values may be provided; in this case, the time durations for smaller lower limit values must be set shorter. Further, the number of types of malfunction alarm may be only one; however, two or more types such as an expired life alarm and an emergency alarm may be provided as necessary. In addition, the responsibility for determining malfunction may be divided. For example, the fire detector 1 may be responsible for false alarms, while the receiver 2 may be responsible for alarm failures.

Thus, according to the first to eleventh aspects of the present invention, the fire detector is capable of detecting its own malfunction and of quickly announcing malfunction of the high-level emergency in the fire detector.

According to the twelfth to fifteenth aspects of the present invention, when the fire receiver monitors the fire detector for a malfunction, and a malfunction of the high-level emergency in the fire detector can be quickly detected.

What is claimed is:

1. A fire detector comprising:

a physical quantity detecting means for detecting the physical quantity of a fire phenomenon;

a first upper limit value setting means for setting a first upper limit value for an output level of said physical quantity detecting means;

a second upper limit value setting means for setting a second upper limit value which is larger than said first upper limit value;

a first time duration setting means for setting a first time duration;

a second time duration setting means for setting a second time duration which is shorter than said first time duration; and a determining means for determining that said physical quantity detecting means is faulty if it is detected that the output level of said physical quantity detecting means is larger than said first upper limit value for said first time duration, and for determining that said physical quantity detecting means is faulty if it is detected that the output level of said physical quantity detecting means is larger than said second upper limit value for said second time duration.

2. A fire detector according to claim 1, wherein a false alarm warning is issued if it is detected that the output level of said physical quantity detecting means is continuously larger than said first upper limit value for said first time duration or longer, or if it is detected that the output level of said physical quantity detecting means is continuously larger than said second upper limit value for said second time duration or longer.

3. A fire detector according to claim 1, wherein a false alarm warning is issued if it is detected that a mean value of the output level of said physical quantity detecting means during said first time duration is larger than said first upper limit value, or if it is detected that the mean value of the output level of said physical quantity detecting means during said second time duration is larger than said second upper limit value.

4. A fire detector comprising:

a physical quantity detecting means for detecting the physical quantity of a fire phenomenon;

a first lower limit value setting means for setting a first lower limit value for an output level of said physical quantity detecting means;

a second lower limit value setting means for setting a second lower limit value which is smaller than said first lower limit value;

a first time duration setting means for setting a first time duration;

a second time duration setting means for setting a second time duration which is shorter than said first time duration; and a determining means for determining that said physical quantity detecting means is faulty if it is detected that the output level of said physical quantity detecting means is smaller than said first lower limit value for said first time duration, and for determining that said physical quantity detecting means is faulty if it is detected that the output level of said physical quantity detecting means is smaller than said second lower limit value for said second time duration.

5. A fire detector according to claim 4, wherein an alarm failure warning is issued if it is detected that the output level of said physical quantity detecting means is continuously smaller than said first lower limit value for said first time duration or longer, or if it is detected that the output level of said physical quantity detecting means is continuously smaller than said second lower limit value for said second time duration or longer.

6. A fire detector according to claim 4, wherein an alarm failure warning is issued if it is detected that the mean value of the output level of said physical quantity detecting means during said first time duration is smaller than said first lower limit value, or if it is detected that the mean value of the output level of said physical quantity detecting means during said second time duration is smaller than said second lower limit value.

7. A fire detector comprising:

a physical quantity detecting means for detecting the physical quantity of a fire phenomenon;

a first upper limit value setting means for setting a first upper limit value for an output level of said physical quantity detecting means;

a second upper limit value setting means for setting a second upper limit value which is larger than said first upper limit value;

a first lower limit value setting means for setting a first lower limit value for the output level of said physical quantity detecting means;

a second lower limit value setting means for setting a second lower limit value which is smaller than said first lower limit value;

a first time duration setting means for setting a first time duration;

a second time duration setting means for setting a second time duration which is shorter than said first time duration;

a third time duration setting means for setting a third time duration;

a fourth time duration setting means for setting a fourth time duration which is shorter than said third time duration; and a determining means for determining that said physical quantity detecting means is faulty if it is detected that the output level of said physical quantity detecting means is larger than said first upper limit value for said first time duration, for determining that said physical quantity detecting means is faulty if it is detected that the output level of said physical quantity detecting means is larger than said second upper limit value for said second time duration, for determining that said physical quantity detecting means is faulty if it is detected that the output level of said physical quantity detecting means is smaller than said first lower limit value for said third time duration, and for determining that said physical quantity detecting means is faulty if it is detected that the output level of said physical quantity detecting means is smaller than said second lower limit value for said fourth time duration.

8. A fire detector according to claim 7, wherein the false alarm warning is issued if it is detected that the output level of said physical quantity detecting means is continuously larger than said first upper limit value for said first time duration or more, or if it is detected that the output level of said physical quantity detecting means is continuously larger than said second upper limit value for said second time duration or more, and the alarm failure warning is issued if it is detected that the output level of said physical quantity detecting means is continuously smaller than said first lower limit value for said third time duration or more, or if it is detected that the output level of said physical quantity detecting means is continuously smaller than said second lower limit value for said fourth time duration or more.

9. A fire detector according to claim 7, wherein the false alarm warning is issued if it is detected that a mean value of the output level of said physical quantity detecting means during said first time duration is larger than said first upper limit value, or if it is detected that the mean value of the output level of said physical quantity detecting means during said second time duration is larger than said second upper limit value; and the alarm failure warning is issued if it is detected that the mean value of the output level of said physical quantity detecting means during said third time duration is smaller than said first lower limit value, or if it is detected that the mean value of the output level of said physical quantity detecting means during said fourth time duration is smaller than said second lower limit value.

10. A fire detector according to any one of claims 1 to 9, wherein three or more of said upper limit values are established and three or more time duration which correspond to said upper limit values are established, or three or more of said lower limit values are established and three or more time duration which correspond to said lower limit values are established.

11. A fire detector according to claim 10, wherein said fire detector is at least one of a smoke-fire detector, a heat-fire detector, a flame-fire detector, and a gas-fire detector.

12. A fire detector according to any one of claims 1 to 9, wherein said fire detector is at least one of a smoke-fire detector, a heat-fire detector, a flame-fire detector, and a gas-fire detector.

13. A fire receiver comprising:

a first upper limit value setting means for setting a first upper limit value for an output level which corresponds to a physical quantity of a fire phenomenon detected by a fire detector;

a second upper limit value setting means for setting a second upper limit value which is larger than said first upper limit value;

a first time duration setting means for setting a first time duration;

a second time duration setting means for setting a second time duration which is shorter than said first time duration; and a determining means for determining that said fire detector is faulty if it is detected that said output level is larger than said first upper limit value for said first time duration, and for determining that said fire detector is faulty if it is detected that said output level is larger than said second upper limit value for said second time duration.

14. A fire receiver comprising:

a first lower limit value setting means for setting a first lower limit value for an output level which corresponds to the physical quantity of a fire phenomenon detected by a fire detector;

a second lower limit value setting means for setting a second lower limit value which is smaller than said first lower limit value;

a first time duration setting means for setting a first time duration;

a second time duration setting means for setting a second time duration which is shorter than said first time duration; and a determining means for determining that said fire detector is faulty if it is detected that said output level is smaller than said first lower limit value for said first time duration, and for determining that said fire detector is faulty if it is detected that said output level is smaller than lower limit value for said second time duration.

15. A fire receiver comprising:

a first upper limit value setting means for setting a first upper limit value for an output level which corresponds to the physical quantity of a fire phenomenon detected by a fire detector;

a second upper limit value setting means for setting a second upper limit value which is larger than upper limit value;

a first lower limit value setting means for setting a first lower limit value for said output level;

a second lower limit value setting means for setting a second lower limit value which is smaller than said first lower limit value;

a first time duration setting means for setting a first time duration;

a second time duration setting means for setting a second time duration which is shorter than said first hour;

a third time duration setting means for setting a third time duration;

a fourth time duration setting means for setting a fourth time duration which is shorter than said third time duration; and a determining means for determining that said fire detector is faulty if it is detected that said output level is larger than said first upper limit value for said first time duration, for determining that said fire detector is faulty if it is detected that said output level is larger than said second upper limit value for said second time duration, for determining that said fire detector is faulty if it is detected that said output level is smaller than said first lower limit value for said third time duration, and for determining that said fire detector is faulty if it is detected that said output-level is smaller than said second lower limit value for said fourth time duration.

16. A fire receiver according to any one of claims 13 to 15, wherein three or more of said upper limit values are established and three or more time durations which correspond to said upper limit values are established, or three or more of said lower limit values are established and three or more time durations which correspond to said lower limit values are established.

* * * * *